United States Patent [19]

Granger

[11] Patent Number: 4,648,530

[45] Date of Patent: Mar. 10, 1987

[54] AUTOMATIC DISPENSER OF PRE-CUT AND Z-WRAPPED OR FOLDED WEB MATERIALS

[76] Inventor: Maurice Granger, 17 rue Marcel Pagnol, 42270 Saint.Priest-en-Jarez, France

[21] Appl. No.: 816,998

[22] Filed: Jan. 9, 1986

Related U.S. Application Data

[63] Continuation of Ser. No. 539,968, Oct. 7, 1983, abandoned.

[30] Foreign Application Priority Data

Jul. 27, 1982 [FR] France ..... 82 13443
Oct. 15, 1982 [FR] France ..... 82 17587

[51] Int. Cl.[4] ..... A47K 10/24

[52] U.S. Cl. ..... 221/34; 221/63; 221/155; 221/307

[58] Field of Search ..... 221/34, 44, 45, 46, 221/63, 307, 309, 310, 267, 48–55, 155; 206/409; 225/106

[56] References Cited

U.S. PATENT DOCUMENTS

| | | | |
|---|---|---|---|
| 1,478,329 | 12/1923 | Ek | 221/53 |
| 1,989,381 | 1/1935 | Samson | 221/34 X |
| 3,490,645 | 1/1970 | Glass et al. | 221/48 |
| 4,179,055 | 12/1979 | Milner | 225/106 X |
| 4,180,160 | 12/1979 | Ogawa et al. | 221/63 X |
| 4,262,816 | 4/1981 | Margulies | 221/63 X |
| 4,289,262 | 9/1981 | Finkelstein | 221/63 X |
| 4,328,907 | 5/1982 | Beard | 221/63 |

*Primary Examiner*—F. J. Bartuska
*Attorney, Agent, or Firm*—Eric P. Schellin

[57] ABSTRACT

An automatic dispenser for pre-cut Z-folded web materials wherein the dispenser comprises a holder or support having an orifice through which the web materials are pulled. The orifice has outwardly rounded edges so that the web can be pulled with unequal pulling forces and from different directions. In some embodiments the orifice is provided with an obturator having two opening elements that are elastically coupled to one another. The obturator has round edges through which the web passes wherein one of the edges can be separated from the other.

15 Claims, 24 Drawing Figures

Fig. 5
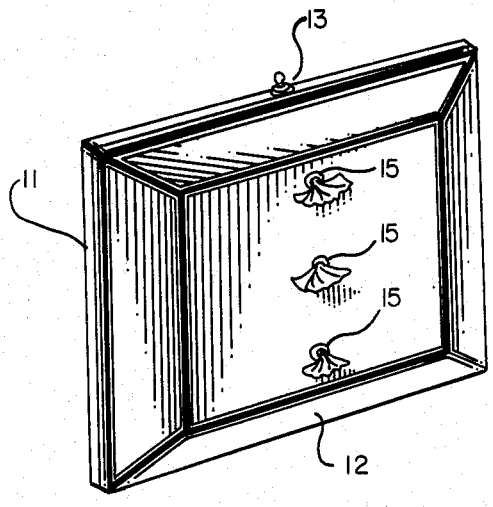
Fig. 6
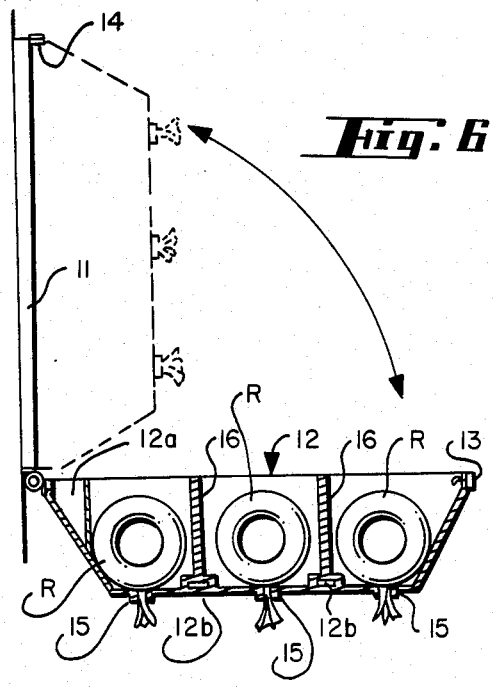
Fig. 7
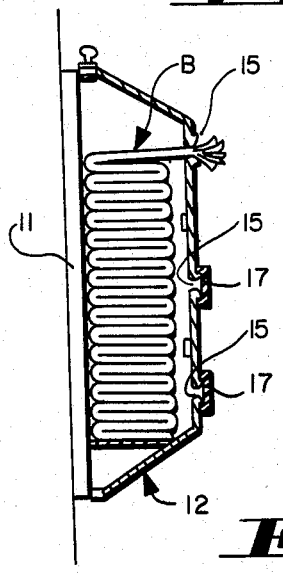
Fig. 8
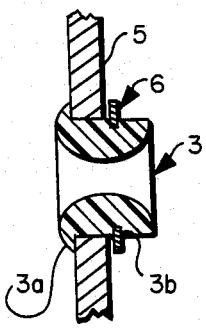
Fig. 9
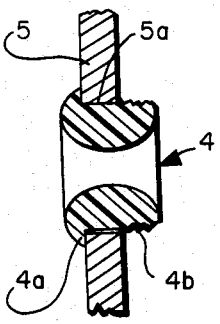
Fig. 10
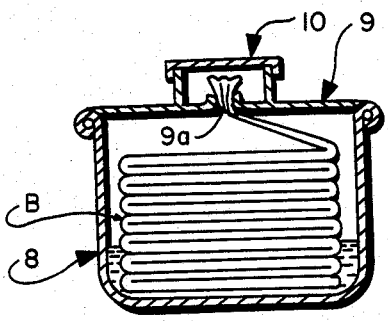
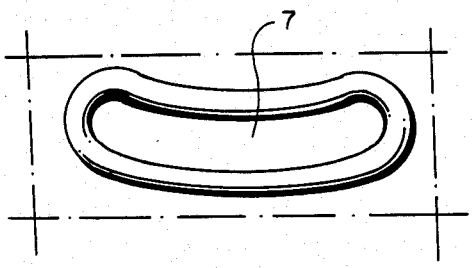
Fig. 11

Fig. 12
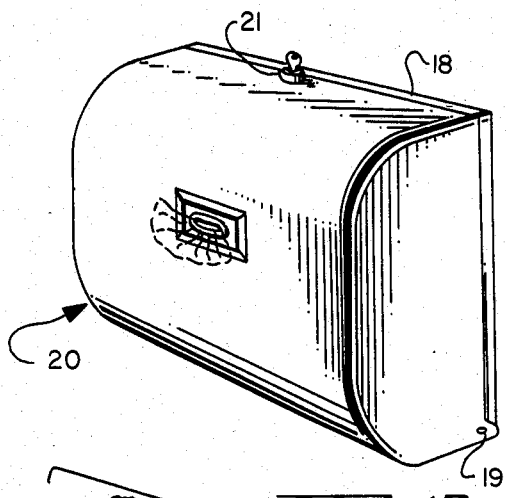
Fig. 16
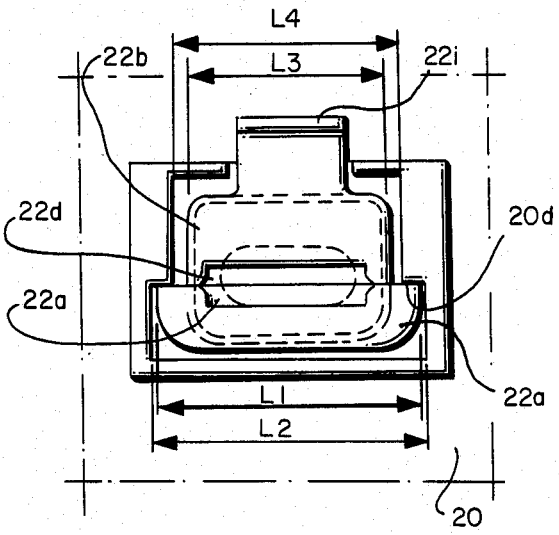
Fig. 13
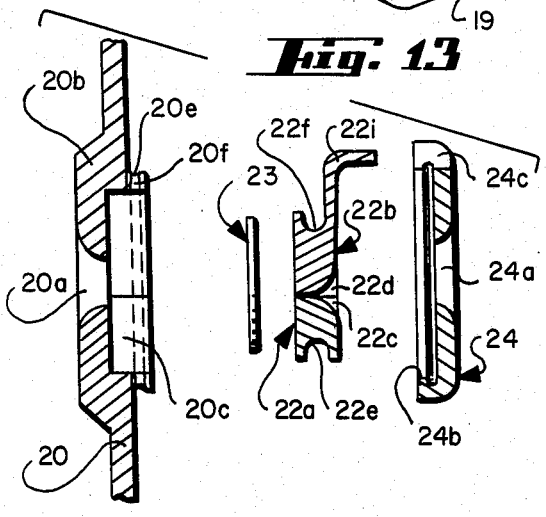
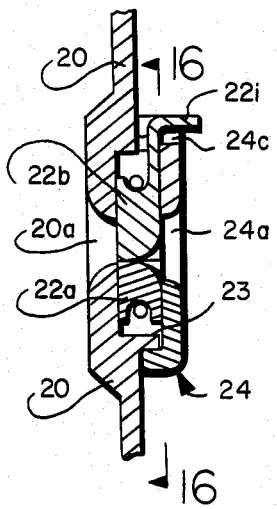
Fig. 14
Fig. 15
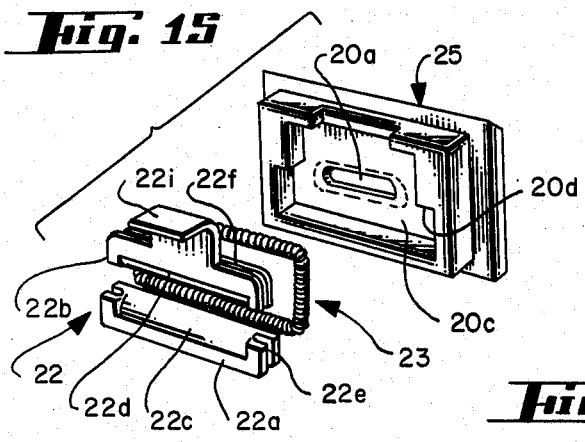
Fig. 18
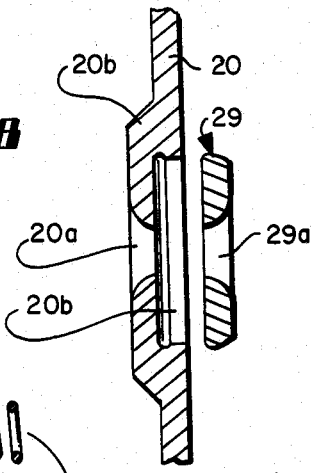
Fig. 17
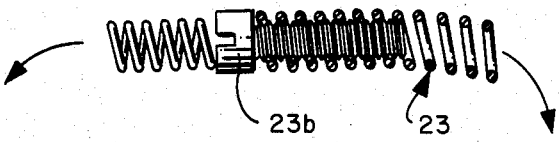

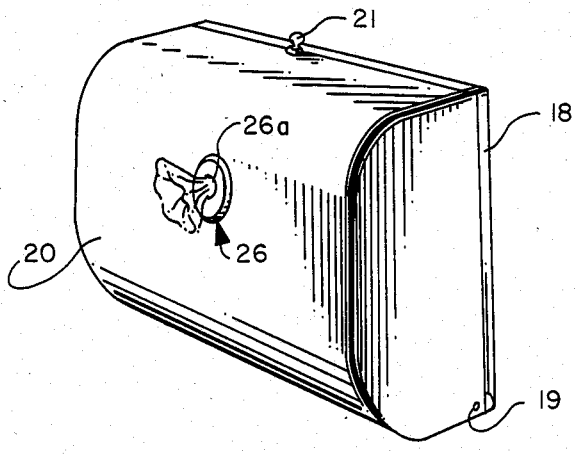
Fig. 19
Fig. 24
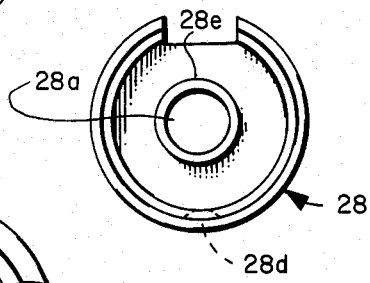
Fig. 21
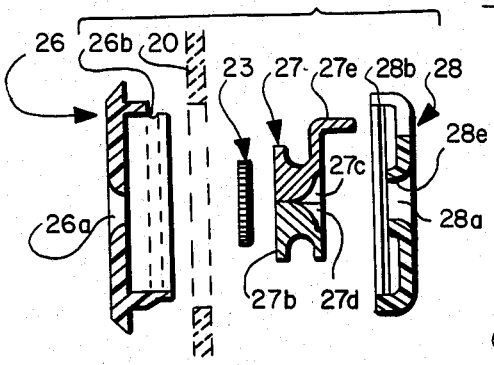
Fig. 23
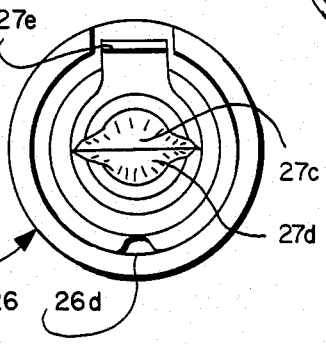
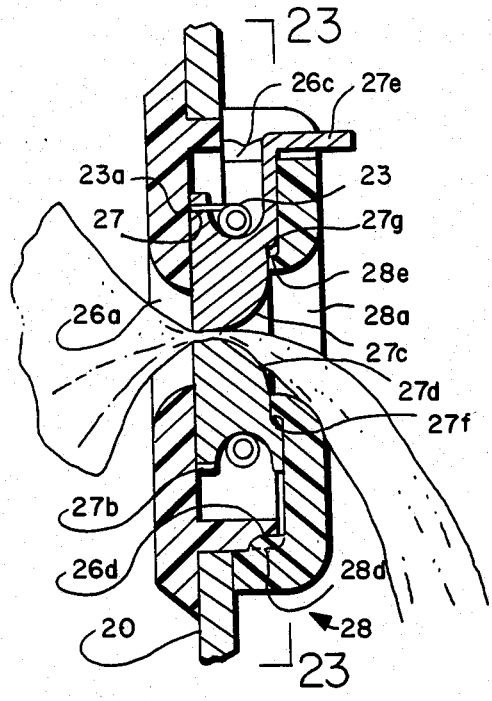
Fig. 22
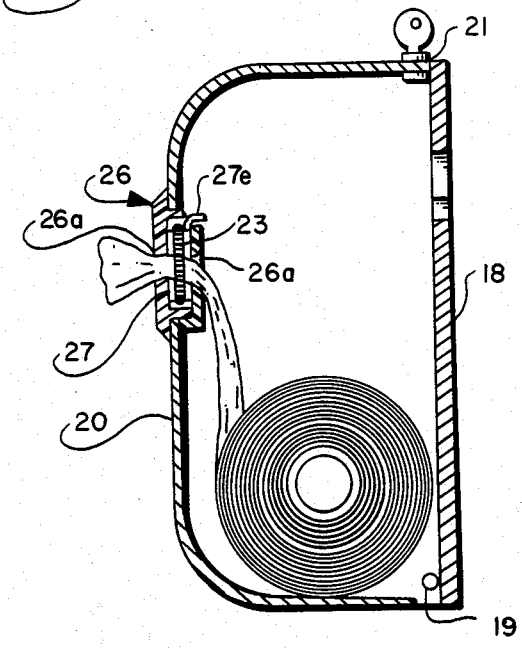
Fig. 20

AUTOMATIC DISPENSER OF PRE-CUT AND Z-WRAPPED OR FOLDED WEB MATERIALS

This application is a continuation of application Ser. No. 539,968, filed Oct. 7, 1983, now abandoned.

BACKGROUND OF THE INVENTION

1. Field of the Invention

The object of the invention pertains more particularly to household and sanitary apparatus and devices, and more particularly still to dispensers for wiping materials such as cotton wool, unwoven materials, crimped paper . . .

2. Description of the Prior Art

The French Pat. No. 2.273.503 and the British Pat. No. 1.382.183 are more particularly known, in which dispensers for pre-cut and folded webs are shown, which have a plate with an opening designed for permitting the webs to be atuomatically torn off along pre-perforated lines when the protruding portion of the web is pulled out, and also for permitting the next web to project out.

In the first case, the opening has a complex shape, with acute angles and dimensions which depend upon many parameters such as: dimension and shape of the webs, quality of the webs, composition of the moistening product, material of the plate (flexible or rigid), pattern of the connection between the webs.

In the second case, the opening is made in the form of a cross slot and of flexible material, and the tearing of is performed by elastic friction of the lips of the opening.

It will be apparent that in these two embodiments, the reliability of the dispenser is not guaranteed, as a wrong pull, or a wrongly oriented pull on the protruding web will be sufficient for the pulled web not to be torn away, or wrongly torn away, or still will be sufficient for the pulling out of several webs.

SUMMARY

In accordance with the invention, a very simplified, and therefore an economic dispenser has been designed, which is quite reliable in operation, i.e. this dispenser will guarantee the pulling out of a web, and the automatic projectoin of the next web, by pulling under any angle and with any pulling force.

For this purpose, the dispenser in accordance with the invention is remarkable in that the device includes on one of the walls thereof one or more rigid and non-deformable orifices in the active position, and in that the sectional shape and the dimensions of the orifice or orifices are exclusively calculated in dependence upon the type of the material which is used, so that at each pull given in any direction and with any force, on the web end which is protruding out of the orifice, the pulled web will be automatically and systematically taken out while allowing automatically a fresh web end to project from the wall of the support or receptacle.

In accordance with a further characteristic, the rigid orifice or orifices for the passage of the webs therethrough are adjustable concerning their dimensions and their resistance to the threading away of the material during the actuation of the dispenser; for this purpose, the orifice for the passage of the web therethrough consists of an opening with fixed dimensions made directly or in an inserted manner within a wall of the support or receptacle for the materials, of a further opening with fixed dimensions made on a mask or a casing adapted on the wall or on the element provided with the first opening, of an obturating device made of two portions connected elastically with one another, in order to exert a force of resistance upon the unstressed material and to permit a correct dispensing when said material is pulled, by means of the spacing apart of one of the two portions of the obturating device.

These and other characteristics will be apparent from the following descripiton.

BRIEF DESCRIPTION OF THE DRAWINGS

To make the object of the invention better understood, the invention will be described now with reference to the following drawings, hereto attached, in a non limitative manner. In the drawings:

FIG. 5 is a perspective view illustrating a further example of embodiment of the dispenser for pre-cut material to be paid off as a roll.

FIG. 6 is a side and sectional view of the dispenser in accordance with FIG. 5, shown in an open position.

FIG. 7 is a sectional view illustrating a form of embodiment of the dispenser similar to the embodiment of FIGS. 5 and 6.

FIGS. 8 and 9 are sectional views in part, on a larger scale, showing other forms of embodiment of the orifice for the passage of the material therethrough.

FIG. 10 is a sectional view illustrating a form of embodiment of the dispenser for pre-cut and Z-folded webs, with a supply of scent or toilet water.

FIG. 11 is a partial view on a larger scale showing a form of embodiment of the orifice for the passage of the material therethrough.

FIG. 12 is a perspective view showing an example of embodiment of the dispenser equipped with an orifice the passage of which is adjustable and the shape of which is generally rectangular.

FIG. 13 is a view illustrating separately and in section the constituent elements of the adjustable orifice in accordance with a first form of embodiment.

FIG. 14 is a view similar to FIG. 13, showing the assembled elements of the adjustable orifice.

FIG. 15 is a perspective view illustrating separately the obturating device made of two parts, the obturator holding element inserted within the wall of the support, and the spring for the elastic recoil.

FIG. 16 is a view along the line 16—16 of FIG. 14, illustrating the elements according to FIG. 15 in the assembled condition.

FIG. 17 is a partial view showing a means for adjusting the tension of the recoil spring.

FIG. 18 is a sectional view illustrating a further form of embodiment of the orifice for the passage of the material therethrough.

FIG. 19 is a perspective view showing a circular form of embodiment of the adjustable orifice in accordance with the invention.

FIG. 20 is a sectional view of the dispenser according to FIG. 12.

FIG. 21 is a view illustrating separately and sectionally the constituent elements of the adjustable orifice in accordance with FIG. 20.

FIG. 22 is on a larger scale a sectional view showing the elements according to FIG. 21, assembled and mounted within the wall of the support or receptacle.

FIG. 23 is a view along the line 23—23 of FIG. 22, illstrating the obturator holding element and the obturating device according to FIGS. 21 and 22, in the assembled condition.

FIG. 24 is a view showing the inside face of the mask or casing covering the obturating device.

DETAILED DESCRIPTION

To make the object of the invention more concrete, the invention will be described now with reference to the non restrictive forms of embodiment illustrated in the Figures of the drawings.

In accordance with a simplified form illustrated in FIGS. 1 to 4, the dispenser of the invention includes a wall support or a support to be placed on a work surface, consisting of a U-shaped element (1) for example, the bottom (1*a*) of which may be straight or concave for receiving a roll (R) of pre-cut material, the width (a) of which is somewhat greater than the diameter of the whole roll. The walls or wings (1*b*) are upturned on the same side, at right angles or not, for retaining the roll.

Figure 1:
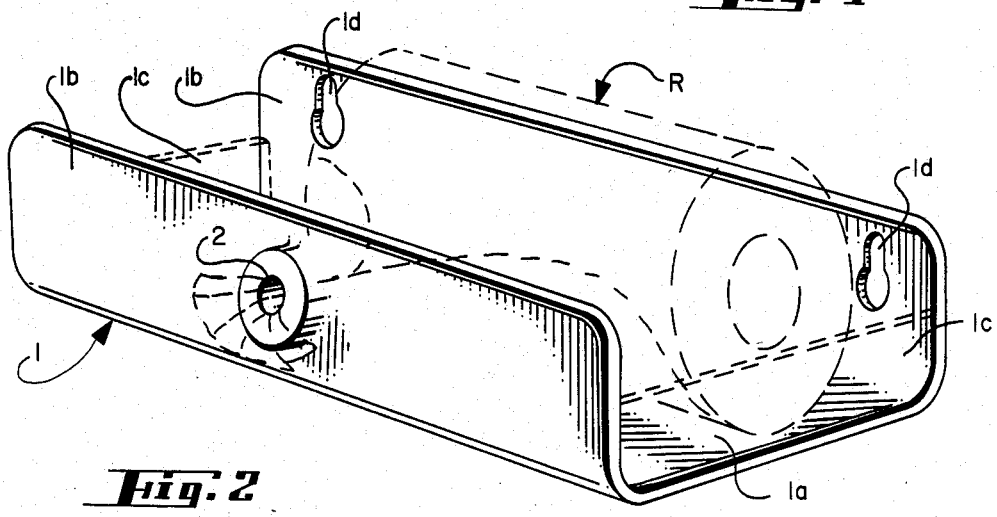
FIG. 1 is a perspective view illustrating a very simplified form of embodiment of the dispenser in accordance with the invention, for dispensing pre-cut material to be paid-off as a roll.
Figure 2:
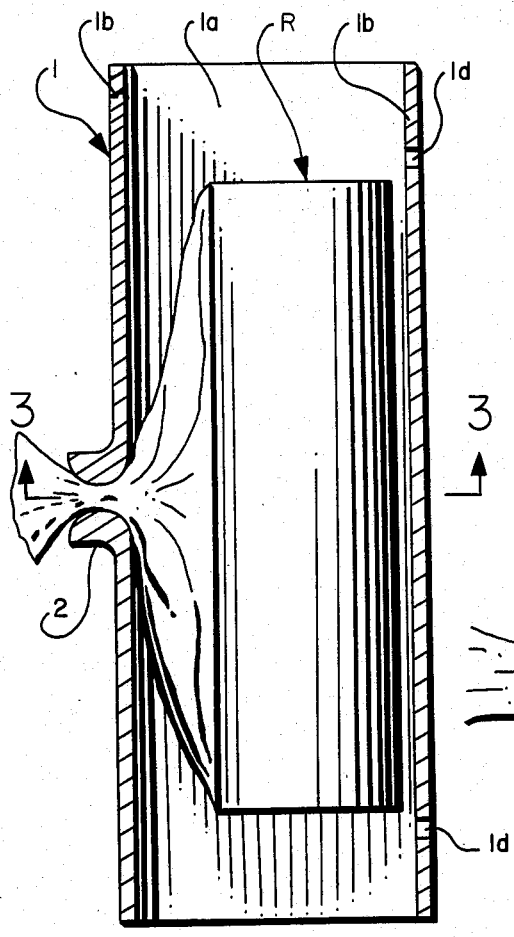
FIG. 2 is a plane sectional view corresponding to FIG. 1 and to the line 2—2 of FIG. 3.
Figure 3:
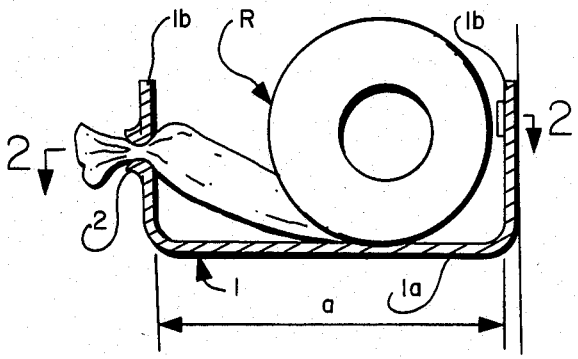
FIG. 3 is a cross sectional view along the line 3—3 of FIG. 2, showing the dispenser in an inactive position or after the removal of a web.
Figure 4:
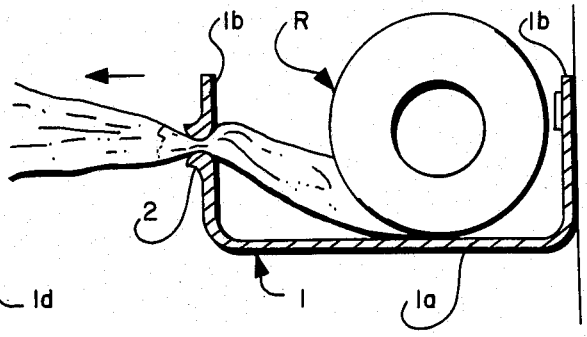
FIG. 4 is a sectional view similar to FIG. 3, but this Figure a web is being pulled out and is going to be taken off along the pre-cut line thereof.

Lengthwise, the support (1) can be formed by walls (1*c*), as illustrated in dashed lines in FIGS. 1 and 2, however, this is not necessary for retaining the roll of material, as said roll is maintained by the free end thereof, which is engaged within an orifice or eyelet (2) provided on one of the wings of the support, preferably in the medial portion.

On the opposite side, the wing of the support may be provided with button-holes (1*d*) or similar means for hooking up the support on screws, ring-bolts or similar organs.

In a preferred but non-limitative manner, the support (1) is made economically of molded material together with the orifice or the eyelet (2) for the passage of the web material therethrough.

It will be understood that other embodiments of the support are possible, as well concerning the general shape thereof as concerning the manner in which the eyelet is made.

For instance, in FIGS. 8 and 9, it will be seen that eyelets (3 and 4) are inserted on the wall of the support (5) which is provided for this purpose with a hole (5*a*) for the engagement of the eyelet. It must be pointed out that the eyelet mounted in this manner is to be retained definitely or temporarily on the wall.

In the case of a final mounting, a riveting, a welding or a bonding may be contemplated, while in the case of a detachable eyelet, a screw thread may be provided in order to screw in the eyelet into the wall, or elasticity slits may also be provided. In FIG. 8, the eyelet (3) has a collar (3*a*) for abutment against the wall (5), while an elastic ring of the circlips type (6) retains the eyelet by means of a groove (3*b*).

In FIG. 9, the eyelet (4) is also provided with an abutment collar (4*a*), while on the other side with a screw thread (4*b*) or similar projections and roughened portions the size of which is slighlty greater than the section of the orifice (5*a*) in the wall, so that the eyelet will be forced therein and retained efficiently between the collar and the screw thread.

It will be also understood that the shape and the section for the passage of the eyelet, either molded directly or inserted, may be selected at will. The tests have shown that a circular section gives satisfaction in any case, provided that the inside diameter of the eyelet should be selected carefully in accordance with the type of the material to be paid off, in order to obtain the desired effect, namely: the automatic removal of a pulled web after the passage of the pre-cut lines through the eyelet, which permits the automatic projection of a fresh web.

When the passage is too large, there could be the risk that the pulled web will not come off; on the contrary, when the passage is too narrow, the web could be jammed or ripped up prior to the passage thereof.

On the other hand, any risk of the web of material hanging up during the passage thereof must be prevented, always for the purpose of obtaining the removal at the desired location.

For this purpose, there is contemplated a passage orifice which is quite broadly rounded at the ends thereof, as shown in FIGS. 8 and 9 more particularly, and the portion of the passage orifice or eyelet situated within the support, on the side of the roll or of the stack, must be minimal, possible zero, in any case very profiled.

Other shapes in passage section give satisfaction, for instance the orifice (7) in FIG. 11, which is bean-shaped, with of course rounded portions which are widely dimensioned.

With removable, and therefore interchangeable eyelets, it is possible to place on the same support or receptacle various eyelets with different lower diameters and adapted to the type of material to be distributed (width, thickness, nature . . . ).

As said in the background of this specification, the dispenser in accordance with the invention is designed for materials in the form of pre-cut webs to be dispensed as a roll or in a Z-folded shape.

As may be seen in FIG. 10, the principle of the invention can be used for dispensing automatically the pre-cut and Z-folded webs (B), which have been disposed within a container (8) filled with a scented or quickening liquid. The sealed cover (9), adapted correctly on the container, is provided directly or in an inserted manner with an orifice or eyelet (9*a*) for the passage of the material therethrough, and the drying of the webs or the evaporation of the liquid is prevented by means of an obturating plug (10).

From the simplified embodiment as illustrated in FIGS. 1 to 4, it is possible, within the scope of the invention, to carry out a dispenser for wiping materials which will be more elaborate in order to meet other requirements, for instance in the public toilets (airports, railway stations, theatres, sport rooms, tearooms, stores . . . ).

In this case, the dispensing shoud be designed with a maximal capacity, and re-loading must be easy, while preventing an excessive waste.

There has been illustrated in FIGS. 5, 6 and 7 in a non-limitative manner, a three-stage dispensing device. The apparatus is comprised for example of a plate (11) for securing to the wall, to which is jointed a cover or box (12) which is preferably with tapering faces for an easier stacking. The cover or box is provided in a known manner with an interlocking lock (13) co-operating with a bolt (14) on the plate (11).

The front wall of the cover or box is provided directly or in an inserted manner with three orifice or eyelets (15) for the passage of the material to be dispensed therethough, these orifices or eyelets being disposed regularly in a vertical plane.

As described in this exemplary embodiment, the dispensing device can be used for rolled up materials, and for Z-folded materials as well, which allows the possibilites to be multiplied by two with the same tooling.

Effectively, when it is desired to equip the dispensing device with three rolls of material (R), such surfaces for abutting and retaining the rolls are provided as a straight bottom (12*a*) of the cover or box, and shelves (16) mounted for example on a slideway (12*b*) of the cover or box (FIG. 6). Once the cover or box is closed, three rolls abutting against the shelves and the wall securing plate, and three dispensing possibilities are thereby available.

When it is desired to dispense pre-cut webs (B) of Z-folded material, (FIG. 7), it is merely necessary to remove the shelves (16) to allow the stack to rest on the straight bottom (12*a*). The successive webs of material are pulled from the upper passage eyelet, while the other eyelets are obturated or changed for transparent plugs (17) in order to permit the visual supervision of the filling level.

There may be seen in FIG. 12 an example of embodiment of the dispensing device equipped with an adjustable orifice for the passage of the material therethrough, in accordance with an alternative form of embodiment.

The dispensing device is comprised for example of a plate (18) for securing to the wall, with at the lower end a joint or hinge (19) for the assembly of a contoured cover (20) which is generally interlocked with the housing by means of a lock (21) or similar organ.

The adjustable orifice for the passage of the material therethrough is placed on the front wall preferably in the upper portion, or at least above the axis of the roll of material which is resting on the bottom of the cover.

According to the embodiment illustrated in FIGS. 13 and 14, the adjustable orifice consists of a first opening (20*a*) for the passage of the material therethrough, said opening being formed on a boss (20*b*) of the wall. This opening emerges rearwardly into a chambering (20*c*) which is generally T-shaped, an obturating device (22) made of two portions being housed therein.

The obturating device comprises a lower portion (22*a*) consisting of an approximately rectangular small bar having a length L1 which is slightly lower than the length L2 of the chambering (20*c*) in order to abut by the upper face thereof against the shoulder (20*d*) of the chambering. The upper portion (22B) has also a generally rectangular shape, however with a length L3 which is less than the length L1, in order to be housed with some clearance within the upper portion of the chambering with a length L4 (FIG. 16).

The opposite faces of the parts (22*a*- 22*b*) of the obturating device are provided on the side opposite to the opening (20*a*) with rounded portions (22*c*- 22*d*) which are widely dimensioned, and this on the greater part of their length, as shown in FIGS. 15 and 16.

On the periphery, the two parts of the obturating device are provided with a groove (22*e*- 22*f*) for housing an elastic return means such as a coil spring (23) connected at both ends either directly when the adjustable tensioning of the spring is not desired, or through the intermediary of an adjusting means such as a screw (23*b*) having the same pitch as the spring (FIG. 17). It is also possible, as illustrated in FIG. 22, that the ends (23*a*) of the spring will be engaged with the holes (27*h*- 27*i*) drilled on the parts (27*a*- 27*b*) of the obturating device.

The upper portion (22*b*) of the obturating device is also provided with a bent extension (22*i*) on the internal side when this portion is positioned within the chambering, in order to permit said upper portion (22*b*) to be spaced apart manually against the spring relative to the lower portion (22*a*) which is then maintained in abutment against the shoulder of the chambering.

The obturating device (22) disposed within the chambering (20*c*) is held in position, with free sliding of the upper portion, by a mask or housing (24) provided in the middle thereof with a fixed opening (24*a*) having the same shape as the opening (20*a*) with preferably a larger section. It will be understood that these two fixed openings have a lower length which is less than the length of the rounded portions (22*c*- 22*d*) of the obturating device, and that said openings are widely rounded in the opposite direction, in order to form in combination with the obturating device, as clearly seen in FIGS. 14 and 22, a passage orifice preventing any jamming of the material.

The mask or housing (24) can be held in position on the boss (20*b*) around the chambering (20*c*) by any means such as bonding, screwing, or as illustrated, by clipping of two complementary portions of the bead (24*b*) and groove (20*e*) type.

It will be noted that the mask or housing (24) and the boss (20*b*) have also at the upper portion thereof an outstepped portion (20*f* and 24*c*) for the passage of the extension (22*i*) of the obturating device.

As illustrated in FIG. 15, the opening (20*a*), the boss (20*b*) and the chambering (20*c*) can be provided on an independent piece (25) engaged within an opening of the wall (20) with dimensions corresponding to the external dimensions of the chambering (20*c*).

In accordance with a further form of embodiment illustrated in FIGS. 19 to 24, the adjustable orifice for the passage of the material therethrough has a generally cylindrical shape.

The same elements as before will be found again here, namely: an obturator holder (26) in the form of an independent piece or of a piece formed within the wall (20), an obturating device (27) made of two portions (27*a*- 27*b*) which are elastically interconnected, and a mask or housing (28) clipped or secured otherwise on the obturator holder. These three elements define the adjustable orifice for the passage of the material therethrough, as will be seen in FIGS. 20 and 22, with the fixed openings (26*a*) (28*a*) and the rounded portions (27*c*- 27*d*).

There will also be found again the gripping extension (27*e*) of the obturating device and the clipping by bead (28*b*) and groove (26*b*) of the mask on the obturator holder.

Moreover, owing to the circular geometry of the elements, an angular dividing of the mask on the obturator holder is necessary, in order to avoid an approximate assembly which could interfere with the sliding motion of the upper portion (27*b*) of the obturating device relative to the outstepped portions (26*c*) and (28*c*). For this purpose, any known means may be used, such as knobs on one of the elements corresponding to a hole on the other element, notching, or as illustrated in FIGS. 22, 23 and 24, a boss (28*d*) on the mask and a corresponding recess (26*d*) on the obturator holder.

When the upper portion (27*b*) of the obturating device is to be raised for the purpose of opening the orifice in order to load the apparatus or to pull the material, it is also necessary here to hold the lower portion. This can be effected for instance by means of a half-circular clearance (27*f*- 27*g*) in the face of the portions of the obturating device opposite the mask, which is provided for this purpose with an axial collar (28*e*).

There is still illustrated in FIG. 18 an alternative form of embodiment of the adjustable orifice for the passage of the material therethrough, according to which a boss (20*b*) with a rounded opening (20*a*), or also an independent piece comprising this opening, has at the lower side thereof a chambering (20*h*) for engaging and retaining therein (through clipping or otherwise) the detachable eyelets (29) with openings (29*a*) of different diameters corresponding to the type of the material to be dispensed.

It will be understood that the various elements of the dispensing device may be made in any size and of any materials.

The advantages will be clearly apparent from the description and the following features will be moreover more particularly pointed out:

the simplicity and the economy of the manufacture of the dispensing device in the more sober embodiment thereof;

the many possibilities of adaptation in accordance with the nature of the materials to be distributed, the conditions of use, the nature of the users . . .

the operational simplicity and reliability obtained with a dispensing device of this type;

the adjustable orifice, making it possible to adjust the opening in accordance with the dimensions and the type of the materials to be distributed and to control the operation in any case, even when two layers of material are present simultaneously at the orifice;

the obturating device with an inconspicuous slit, which is so to speak invisible from outside when the obturating device is not operating, when this slit is located on a side of or below the opening (20*a*), preventing a damaging action with a sharp-pointed object to cause the projecting material to be urged back into the dispensing device;

the many possiblities of adaptations according to the requirements thanks to the detacable eyelets, the easily interchangeable obturating devices, and the adjustment of the resistance to the unwinding by actuating the elastic return means;

the possiblity to accommodate several adjustable orifices on the same support.

I claim:

1. An automatic dispenser for precut materials folded into a Z-shaped configuration, comprising a support means (1, 8 or 12) for the material having one wall having at least one rigid, non-deformable orifice (2, 3, 4, 7, 9*a* or 15) with a selected dimension, through which the material is pulled, so that at each pull of the material the pulled portion of the material is automatically detached, leaving a new portion of the material extending out of the orifice, the orifice is characterized in that in order to systematically assure the detachment of the pulled portion and extension of the new portion from whatever pulling force and pulling direction, the orifice extends outside of the support means, opposite the folded material, and is provided with an entry section adjacent to the folded material, an exit section opposite the entry section outside the support means, and a median section located between the entry and exit sections, the orifice has very broadly rounded and flared out entry and exit sections, while the median section is formed solely as a function of the type of material used, the support means comprises a wall attachment plate (11) to which a hood (12) having inclined faces and a bolting lock is articulated, the hood is provided with at least one orifice for the passage of at least one roll of folded material, further characterized in that the hood accommodates a plurality of rolls of folded material, the hood is provided with a straight bottom (12*a*) for support one roll and grooves (12*b*) having removable spokes (16) which support the other rolls of folded material, and whereby each roll is provided with a separate orifice (15) wherein each orifice not provided with a roll of material passing therethrough is obturated by transparent plugs which allow the filling level to be checked.

2. An automatic dispenser according to claim 1, characterized in that the orifice is formed by an opening (20*a* or 26*a*) of fixed dimension located in the wall of the support means, the orifice is provided with an obturator device (22 or 27) having two facing opening elements elastically connected to one another in order to exert a resistance force on the material at rest to permit a correct dispensing when the material is pulled by having one of the two elements separating from the other element.

3. An automatic dispenser according to claim 2, characterized in that the two opening elements of the obturator device have broadly dimensioned rounded edges (22*c*, 22*d* or 27*c*, 27*d*) on their facing surfaces which are oriented towards the folded material.

4. An automatic dispenser according to claim 3, characterized in that the two opening elements comprise two semicircular parts (27*a*, 27*b*).

5. An automatic dispenser according to claim 3, characterized in that the two opening elements are rectangular parts (22*a*, 22*b*).

6. An automatic dispenser according to claim 3, characterized in that the orifice is provided with an obturator holder (25 or 26) having another opening of fixed dimension that is adapted to hold the obturator device.

7. An automatic dispenser according to claim 6, characterized in that the another opening of the obturator holder has a wide rounded edge outside the support means to allow the material extending past the another opening to spread out freely while the opening of the support means has a wide rounded edge adjacent the folded material to prevent catching of the material.

8. An automatic dispenser according to claim 6, characterized in that the obturator is provided with a T-shaped recess having stop faces for one of the opening elements of the obturator device to allow the movement of the other opening element.

9. An automatic dispenser according to claim 2 wherein the obturator device is housed in a T-shaped recess in the wall of the support means, wherein the T-shaped recess has stop faces for one of the opening elements of the obturator device to allow movement of the other opening element.

10. An automatic dispenser according to claim 6, characterized in that the obturator is provided with a collar (28*e*) cooperating to semi-release the opening parts of the obturator device and constituting a stop for one of the opening elements.

11. An automatic dispenser according to claim 2, characterized in that one of the two opening elements of the obturator device is provided with a bent extension to provide a manual actuator to separate the opening elements.

12. An automatic dispenser according to claim 2, characterized in that the two elastically connected opening elements of the obturator device are elastically connected by an elastic ring means having two ends that are connected together by a screw (23*b*) to regulate the tension of the ring means.

13. An automatic dispenser according to claim 6, characterized in that the obturator holder is provided with a cover (24 to 28) that is secured to the obturator holder for holding the obturator device.

14. An automatic dispenser according to claim 13, characterized in that the orifice is a circulate regulatable orifice, and the cover of the obturator holder is provided with indexing means so that the opening elements of the obturator device can be released by the sliding of a bent extension of one of the opening elements.

15. An automatic dispenser according to claim 2, wherein the wall of the support means is provided with a boss (20*b*) having an opening for the passage of the material, characterized in that the boss provides a recess (20*h*) in which an eyelet is fixed in a removable manner having widely rounded edges wherein the dimensions of the orifice for the passage of material can be regulated by interchanging eyelet of different dimensions.

* * * * *